United States Patent [19]

Taniuchi

[11] Patent Number: 4,759,464

[45] Date of Patent: Jul. 26, 1988

[54] SAFE OPENING CONTAINER LID

[76] Inventor: Keiji Taniuchi, 6-7, Nishikoujiya 2-chome, Ohta-ku Tokyo 144, Japan

[21] Appl. No.: 50,278

[22] PCT Filed: Sep. 8, 1986

[86] PCT No.: PCT/JP86/00453

§ 371 Date: Mar. 25, 1987

§ 102(e) Date: Mar. 25, 1987

[87] PCT Pub. No.: WO87/01359

PCT Pub. Date: Mar. 12, 1987

[30] Foreign Application Priority Data

Sep. 10, 1985 [JP] Japan ..... 60-198569

[51] Int. Cl.[4] ..... B65D 17/34

[52] U.S. Cl. ..... 220/273

[58] Field of Search ..... 220/268–273

[56] References Cited

U.S. PATENT DOCUMENTS

| | | | |
|---|---|---|---|
| 3,747,797 | 7/1973 | Goyner et al. | 220/268 |
| 3,993,010 | 11/1976 | Taniuchi | 112/121 C |
| 4,397,402 | 8/1983 | Keiji | 220/268 |
| 4,565,298 | 1/1986 | Taniuchi | 220/273 |

FOREIGN PATENT DOCUMENTS 44077 6/1972 Japan .

*Primary Examiner*—George T. Hall

*Attorney, Agent, or Firm*—Sughrue, Mion, Zinn, Macpeak and Seas

[57] ABSTRACT

A container lid having a removable portion which can be torn off by a tear tab. It has an upwardly projecting wall defining the periphery of the removable portion and formed by bending the plate from which the lid is formed. The wall protects a person opening the container against any injury by the torn edge of the removable portion. The wall also contributes to reducing the force which is required for tearing off the removable portion.

4 Claims, 6 Drawing Sheets

SAFE OPENING CONTAINER LID

TECHNICAL FIELD

This invention relates to a container lid having a metal plate portion which can be torn off along a tear line by a pull tab to form an opening. More particularly, it is a container lid which can form an opening having a safe edge when its portion defining the opening is torn off.

BACKGROUND ART

There is known a container lid which can be opened by a pull tab. While this type of lid has mainly been used as the lid of a can holding a beverage, it has also come to be used for a can holding food which is usually of the type which can be opened fully or across the whole area of its lid. In either event, this type of lid has the advantage of being openable more easily and safely than the lid of any can of the conventional type which requires a can opener. However, an opening made by tearing off a lid portion along a tear line forms a sharp edge which is very likely to hurt the fingers or hands of the person who opens the can or touches it thereafter.

Therefore, various attempts have been made to obtain a safer container lid construction. Reference is made by way of example to Japanese Patent Publication No. 44077/1972 for the invention entitled "Metal Container Lid and a Method of Making the Same" and U.S. Pat. No. 4,565,298 for the invention entitled "Safe Opening Container Lid". They propose the container lids which can form an opening having a safe edge.

U.S. Pat. No. 4,397,402 is directed to the invention entitled "Easily Openable Container Lid38 . It discloses a lid which can not only form an opening having a safe edge, but can also form a safe edge about its portion which is removed to make the opening. However, it has no tear tab, but its removable portion is surrounded by a groove in which a piece of hard material can be inserted to raise the removable portion and remove it. It can be formed from a sheet of material having a relatively high degree of ductility, but is difficult to form from a sheet of iron.

Under these circumstances, it is an object of this invention to provide a container lid having a removable portion which presents a safe edge when torn off along a tear line to form an opening in the lid.

It is another object of this invention to provide a container lid having only a low pop value and a low tear value so that, when a tab is raised to tear off its removable portion along a tear line, it may require only a small amount of force and be torn off very easily and safely.

DISCLOSURE OF THE INVENTION

The basic concept of this invention is shown in FIGS. 1 and 2. FIG. 1 is a perspective view, partly in section, of the removable portion of a container lid according to this invention. The removable portion 1 of the lid is defined by a tear line 2 surrounding it. A tear tab 3 is provided on the removable portion 1 and has a tip 3*a* joined to the tear line 2.

FIG. 2 is an enlarged sectional view of that part A of the lid through which the tear line 2 extends, and which constitutes a salient feature of this invention. The removable portion 1 is surrounded by an annular upwardly projecting wall 4 formed by folding a lid plate and having an inverted V-shaped cross section. The wall 4 comprises an outer portion and an inner portion.

The outer portion has a bottom 5 which is located above the bottom 6 of the inner portion. The tear line 2 is provided at the bottom 5 of the outer portion.

The tip 3*a* of the tab 3 is so bent as to be complementary to the wall 4, extend thereover and be joined to the tear line 2, as shown in FIG. 1. However, the tip of the tab need not be bent, if the wall is not completely annular, but has a broken part in which the tip of the tab can be placed, as will hereinafter be described with reference to FIG. 10.

The removal of the removable portion 1 is started at that part 2*a* of the tear line 2 at which the tab 3 is provided. The tab 3 is raised to push down the wall 4, whereupon the tear line 2 is broken at the part 2*a* thereof. The presence of the wall 4 formed by folding the lid plate makes the lid higher in rigidity than any simply planar lid. Therefore, it is possible to produce an effective shearing force at the part 2*a* of the tear line 2 when the tab 3 is raised, and thereby maintain a low pop value.

After the part 2*a* of the tear line 2 has been broken, the tab 3 is pulled up until the removable portion 1 is torn off along the entire tear line 2. FIG. 3 is an enlarged sectional view showing the removal of the removable portion 1.

The removable portion 1 is gradually torn off, as it is pulled up by the tab 3. Therefore, it is usually required to have a tear value which is lower than its pop value. The wall 4 has a sufficiently high degree of hardness obtained when it is formed by folding the lid plate. The presence of the tear line 2 at the bottom 5 of the outer portion of the wall 4 enables the removable portion 1 to be torn off more easily at a lower tear value than any lid having no such wall can be.

As the removable portion 1 is torn off, it obtains a torn edge 7*a* which is formed by its separation from the remaining portion of the lid. Insofar as the bottom 5 of the outer portion of the wall 4 is located above the bottom 6 of its inner portion (FIG. 2), the torn edge 7*a* is formed between the top 4*a* of the wall 4 and the bottom 6 of its inner portion as shown in FIG. 3.

While the torn edge 7*a* is a sharp one, it is held close to the wall 4 between the top 4*a* thereof, which presents a safe curved edge, and the bottom 6 of its inner portion 4*b*. Therefore, there is no fear of the torn edge 7*a* hurting the fingers or hands of anybody when he opens the container, or at any time thereafter.

As the removal of the removable portion 1 proceeds, the outer portion of the wall 4 is pulled toward its inner portion 4*b* and the torn edge 7*a* is, therefore, brought closer to the inner portion 4*b*. This ensures the safety of the lid construction according to this invention to a further extent.

According to the container lid of this invention, the sharp torn edge of its removable portion which is torn off along the tear line by the tab is held close to the peripheral wall of the removable portion between the safely curved top thereof and the bottom of its inner portion and is, therefore, a safe edge which is unlikely to hurt the fingers or hands of anybody when he opens the container, or thereafter.

The presence of the wall defining the periphery of the removable lid portion ensure the effective concentration of stress on the tear line and thereby makes it possible to lower the pop and tear values of the force which is required for tearing off the removable portion.

Moreover, the following advantages of this invention will become obvious from the description of its embodiments which will hereinafter appear:

(1) If the lid has an inclined portion extending upwardly and radially outwardly from the bottom of the outer portion of the wall defining the periphery of its removable portion, the lid portion remaining on the container also presents a safe edge which is directed downwardly toward the interior of the container;

(2) If the wall defining the periphery of the removable portion is inclined upwardly and radially outwardly from its bottom to its top, it provides a still safer lid, as its removable portion presents a torn edge concealed below the wall when it has been torn off; and (3) If the wall defining the periphery of the removable lid portion is partly broken, the tab need not have a bent tip, but is easier to make and attach to the removable lid portion.

Figure 1:
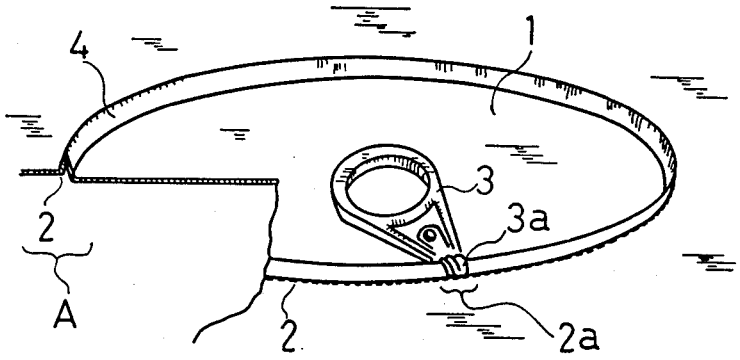
FIG. 1 is a perspective view, partly in section, of the removable portion of a container lid according to this invention.

In the drawings, reference numeral 1 denotes a removable lid portion; 2 a tear line; 2*a* a part of the tear line; 3 a tear tab; 3*a* tip of the tab; 4 an upwardly extending wall; 4*a* bent top edge of the wall; 4*b* inner portion of the wall; 5 bottom of the outer wall portion; 6 bottom of the inner wall portion; 7*a* and 7*b* torn edges; 8 a tear line; 8*a* and 8*b* torn edges; 9 an upwardly extending wall; 9*a* bent top edge of the wall; 10 a removable lid portion; 11 bottom of the outer wall portion; 12 an inclined lid portion; 13 a container; 13*a* a lip bead; 14 bottom of the inner wall portion; 15 and 16 upwardly extending walls; 17 and 18 tear lines; 17*a* and 18*a* torn edges; 19 and 20 removable lid portions; 21 an upwardly extending wall; 22 a removable lid portion; 23 a tear tab; 23*a* tip of the tab; 24 a broken part of the tear line; and 25 a tear line.

BEST MODE OF CARRYING OUT THE INVENTION

The invention will now be described with reference to FIGS. 4 to 11 showing several embodiments thereof.

Figure 2:
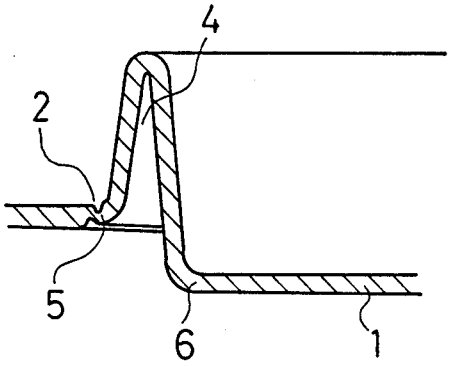
FIG. 2 is an enlarged sectional view showing a part of FIG. 1.
Figure 4:
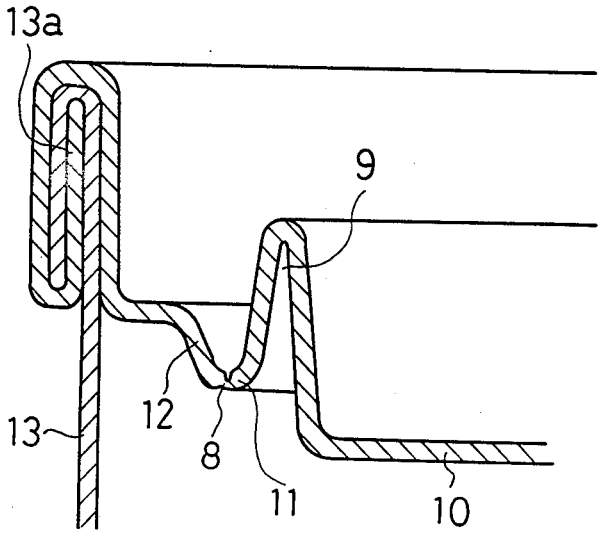
FIG. 4 is a fragmentary enlarged sectional view of a container lid embodying this invention.

Referring first to FIG. 4, there is fragmentarily shown a container lid embodying this invention. It is identical in construction to the lid shown in FIG. 2 insofar as it includes a removable portion 10 defined by a peripheral wall 9 surrounded by a tear line 8. However, it further includes in its unremovable portion an inclined portion 12 extending upwardly and radially outwardly from the bottom 11 of the outer portion of the wall 9. The lid has a lip bead 13*a* which secures it to a container 13.

Figure 3:
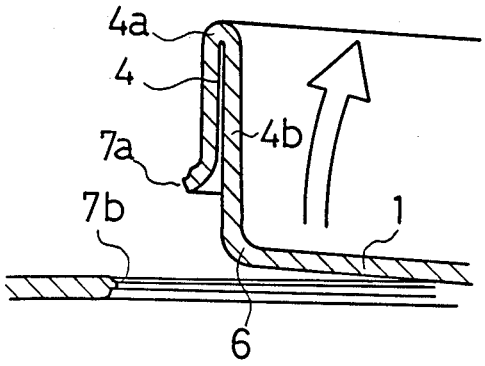
FIG. 3 is a fragmentary enlarged sectional view of the removable lid portion being torn off.
Figure 5:
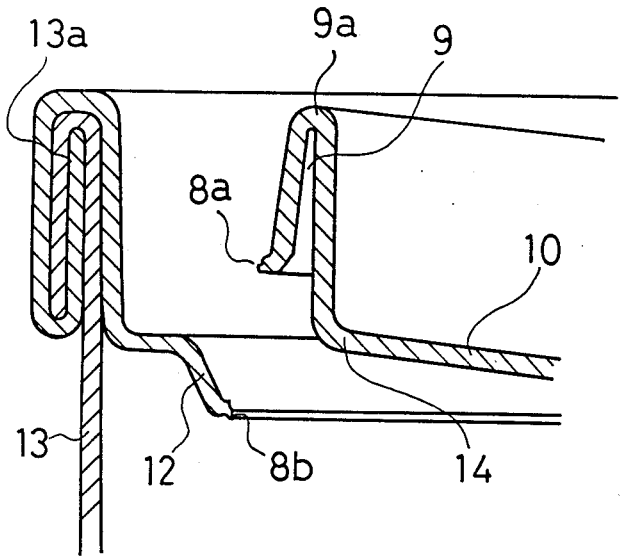
FIG. 5 is a view similar to FIG. 4, but showing the removable portion of the lid being torn off.

FIG. 5 shows how the removable portion 10 is torn off. When the removable portion 10 has been torn off, it has a torn edge 8*a* held close to the wall 9 between the rounded top 9*a* thereof and the bottom 14 of its inner portion and thereby ensure the safety of a person opening the container, as has hereinbefore been described. The lid of FIGS. 4 and 5 has further advantages which are due to the presence of the inclined portion 12. The inclined portion 12 facilitates the concentration of stress on the tear line 8 when the removable portion 10 is torn off. The inclined portion 12 has a higher degree of rigidity than that of a simply horizontal lid portion and a high degree of hardness and enables a further reduction in the pop and tear values. When the removable portion 10 has been torn off, the inclined portion 12 remaining on the container 13 has a torn edge 8*b* directed downwardly toward the interior of the container 13, as opposed to the horizontally directed torn edge 7*b* shown in FIG. 3. Therefore, the lid of FIGS. 4 and 5 ensures safety on not only the torn edge of its removable portion, but also the torn edge of its remaining portion.

Figure 6:
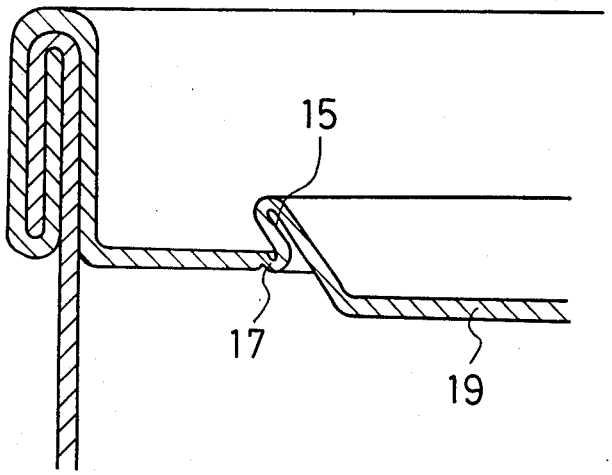
FIG. 6 is a fragmentary enlarged sectional view of a container lid according to another embodiment of this invention.
Figure 7:
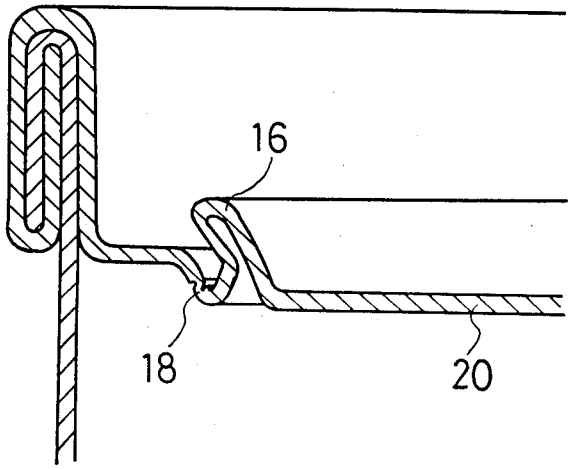
FIG. 7 is a fragmentary enlarged sectional view of a container lid according to still another embodiment of this invention.
Figure 8:
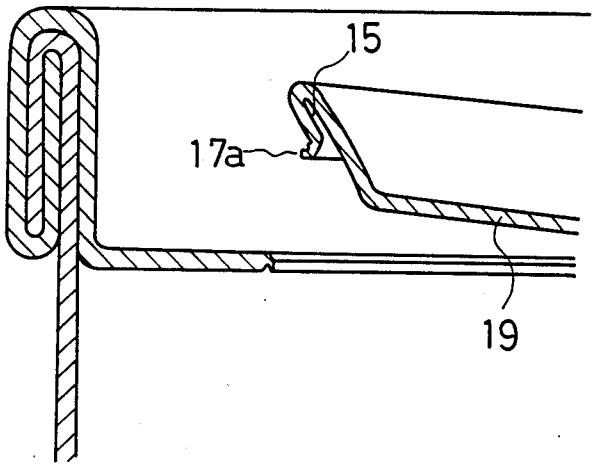
FIG. 8 is a view showing the removal of the removable portion of the lid shown in FIG. 6.
Figure 9:
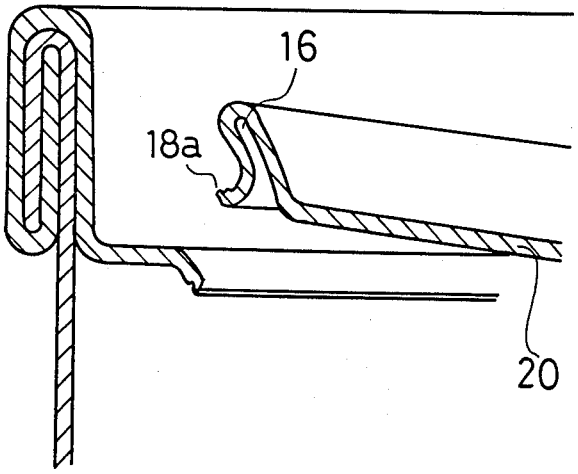
FIG. 9 is a view showing the removal of the removable portion of the lid shown in FIG. 7.

The second and third embodiments of this invention are shown in FIGS. 6 and 7, respectively. These lids are characterized by the peripheral walls 15 and 16 of removable portions 19 and 20, respectively, which are inclined upwardly and radially outwardly from the bottom thereof to the top thereof. The tear lines 17 and 18 are located below the walls 15 and 16, respectively, and when the removable portions 19 and 20 are torn off, the torn edges 17*a* and 18*a* thereof are concealed below the walls 15 and 16, respectively, as shown in FIGS. 8 and 9, respectively, and thereby ensure the safety of a person opening the container. The angle of inclination of either of the walls 15 and 16 can be selected appropriately to enable the adjustment of the bending strength of the removable portion 19 or 20 at its periphery to obtain an appropriate tear value which enables anybody to open the container easily and safely.

Figure 10:
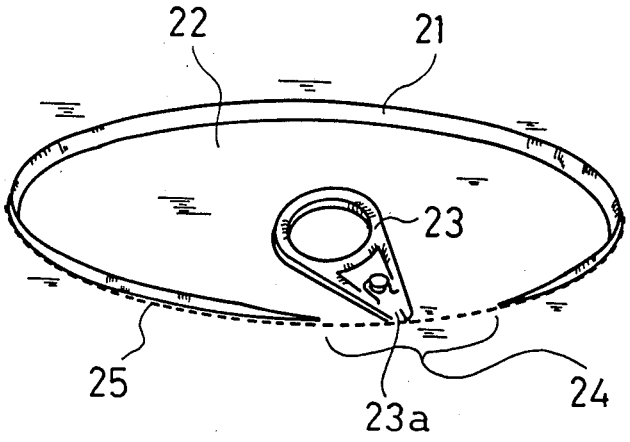
FIG. 10 is a perspective view of the removable portion of a container lid according to a further embodiment of this invention.

The fourth embodiment of this invention is shown in FIG. 10. While every lid that has hereinabove been described has an annular peripheral wall encircling its removable portion completely, the lid of FIG. 10 has a peripheral wall 21 which does not encircle its removable portion 22 completely along its entire periphery, but which has a broken part 24 in which the tip 23*a* of a tear tab 23 is located. A tear line 25, however, extends even through the broken part 24, as well as along the bottom of the outer portion of the wall 21. The lid may, or may not, include an inclined unremovable portion extending from the bottom of the outer wall portion, as shown at 12 in FIG. 4 and as also shown in FIG. 7.

The presence of the broken part 24 in the wall 21 facilitates the preparation of the tab 23 and its attachment to the removable portion 22, since its tip need not be so bent as to suit the shape of the wall as shown in FIG. 1.

Figure 11:
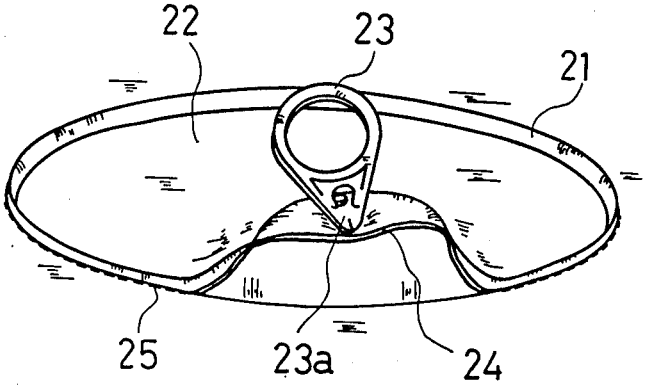
FIG. 11 is a perspective view showing the removal of the removable portion shown in FIG. 10.

While the removable portion 22 has a sharp torn edge exposed along the broken part 24 of the wall 21 as has been the case with any conventional container lid, it does not present any problem from a safety standpoint, since when the tab 23 is raised, its tip 23*a* folds the exposed edge 24 downwardly toward the interior of the container as shown in FIG. 11. As regards the rest of the torn edge, the wall 21 ensures safety, as is obvious from the foregoing description of the other embodiments.

INDUSTRIAL UTILITY

The container lid of this invention having a removable portion which presents a safe edge when it is torn off can be widely used for containers for holding food, beverages, etc.

I claim:

1. A safe opening container lid comprising:

a removable portion surrounded by a tear line;

a tear tab provided on said removable portion and having a tip joined to said tear line; and an upwardly projecting wall extending along said tear line radially inwardly thereof and defining the periphery of said removable portion, said wall being a bent part of a plate forming the lid and having a radially inner portion and a radially outer portion having a top at which it is contiguous to said inner portion, said outer portion having a bottom along which said tear line extends, said inner portion having a bottom located below said bottom of said outer portion.

2. A lid as set forth in claim 1, further including an inclined unremovable portion surrounding said wall and extending upwardly and radially outwardly from said bottom of said outer portion.

3. A lid as set forth in claim 1 or 2, wherein said wall is inclined upwardly and radially outwardly as a whole from its bottom to its top.

4. A lid as set forth in claim 1 or 2, wherein said wall has a broken part in which said tip of said tab is located.

* * * * *